US006452506B2

(12) United States Patent
Wilhelm

(10) Patent No.: US 6,452,506 B2
(45) **Date of Patent: *Sep. 17, 2002**

(54) METHOD OF SIGNALLING TRAFFIC-RELEVANT STATUS INFORMATION

(75) Inventor: Michael Wilhelm, Vaihingen/Enz-Kleinglattbach (DE)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 87 days.

(21) Appl. No.: 09/413,373

(22) Filed: Oct. 6, 1999

(30) Foreign Application Priority Data

Oct. 7, 1998 (DE) ..... 198 46 169

(51) Int. Cl.[7] ..... G08G 1/09

(52) U.S. Cl. ..... 340/905; 340/901; 340/902; 340/904; 455/404; 455/556; 455/557; 455/550

(58) Field of Search ..... 340/901, 902, 340/904, 905, 906; 455/404, 556, 557, 550, 345, 344, 346

(56) References Cited

U.S. PATENT DOCUMENTS

| | | | | | |
|---|---|---|---|---|---|
| 3,626,365 | A | * | 12/1971 | Press | 340/902 |
| 3,876,940 | A | * | 4/1975 | Wickord et al. | 340/902 |
| 4,006,447 | A | | 2/1977 | Narbaits-Jaureguy et al. | |
| 4,238,778 | A | * | 12/1980 | Ohsumi | 340/902 |
| 4,380,821 | A | * | 4/1983 | Eckhardt | 455/33 |
| 4,403,208 | A | | 9/1983 | Hodgson et al. | |
| 4,747,064 | A | * | 5/1988 | Johnston | 340/902 |
| 4,785,474 | A | * | 11/1988 | Bernstein et al. | 340/902 |
| 4,806,931 | A | * | 2/1989 | Nelson | 340/907 |
| 4,964,837 | A | * | 10/1990 | Collier | 446/409 |
| 4,971,583 | A | * | 11/1990 | Umehara | 340/449 |
| 5,239,700 | A | * | 8/1993 | Guenther et al. | 455/158.4 |
| 5,278,553 | A | * | 1/1994 | Cornett et al. | 340/902 |
| 5,287,411 | A | * | 2/1994 | Hill et al. | 340/902 |
| 5,495,242 | A | * | 2/1996 | Kick et al. | 340/902 |
| 5,495,243 | A | * | 2/1996 | McKenna | 340/902 |
| 5,507,288 | A | | 4/1996 | Böecker et al. | |
| 5,825,304 | A | * | 10/1998 | Marin | 340/902 |

FOREIGN PATENT DOCUMENTS

| | | | |
|---|---|---|---|
| DE | 38 42 417 A1 | 6/1990 | |
| DE | 44 40 114 A1 | 7/1995 | |
| DE | 195 24 949 A1 | 2/1996 | |
| DE | 195 47 574 A1 | 10/1996 | |
| DE | 196 04 084 A1 | 10/1996 | |
| DE | 197 30 791 A1 | 1/1999 | |
| WO | WO 96-29831 | 9/1996 | ..... H04Q/7/22 |

OTHER PUBLICATIONS

"Sonntag Aktuell" Dec. 14, 1997.

* cited by examiner

*Primary Examiner*—Jeffery Hofsass
*Assistant Examiner*—Daniel Previl
(74) *Attorney, Agent, or Firm*—Sughrue Mion, PLLC

(57) ABSTRACT

The invention relates to a method of signaling traffic-relevant status information (5), in particular warning signals, to road users. In order to convey warning signals in a simple and reliable manner to road users when these are distracted by terminal equipment, it is provided that the terminal equipment, in particular mobile telephone, audio device, computer, is used for acoustic and/or optical and/or mechanical signaling, during which time the normal function of the terminal is suppressed.

52 Claims, 3 Drawing Sheets

METHOD OF SIGNALLING TRAFFIC-RELEVANT STATUS INFORMATION

BACKGROUND OF THE INVENTION

The invention relates to a method of signaling traffic-relevant status information.

The continuous increase in road traffic calls for a high degree of concentration and attention on the part both of motorized road users and pedestrians. Any distraction, for example the use of a mobile telephone or an audio device at high volume, represents a potential source of danger. Studies have shown that driving errors during telephoning—using a "handy" or hands-free system—are multiplying. Therefore some countries, for example Spain, Portugal, Italy and Switzerland, have imposed a general ban on the use of telephones during car driving. The publication "Sonntag Aktuell" of Dec. 14, 1997 states that this subject is also being discussed in Germany.

SUMMARY OF THE INVENTION

The object of the invention is to signal traffic-relevant status information, in particular warning signals, in a simple and reliable manner to road users when the road users are distracted by electronic equipment, in particular a mobile telephone, audio device or on-board computer.

In accordance with the invention, this object is achieved by a method of signaling traffic-relevant status information, in particular warning signals, to road users, characterised in that existing terminals, in particular mobile telephone, audio device, computer, and used for acoustic and/or optical and/or mechanical signaling, during which time the normal function of the terminal is suppressed. It is provided that the terminals are, as it were, functionally converted in order to signal warning signals to the road user by means of existing assemblies. Inasmuch as the normal function of the terminal is temporarily suppressed during a danger situation, this in itself constitutes a signal leading to increased attention on the part of the road user. However, acoustic and/or optical and/or mechanical signaling is also to be understood as an additional warning-display or announcement or a vibration alarm. What is important is simply that the vehicle driver or pedestrian is startled in some way. The traffic-relevant status information to be signaled consists primarily of vital warning signals, such as for example police- or fire-bridge sirens, vehicle flashing hazard signals, flashing police-car lights, illuminated road-works or traffic lights. Also conceivable is the vehicle-internal signaling of environment status information, such as current pollutant levels, temperature and so on, also status information relating to the vehicle such as for example vehicle noises from the wheel bearings, engine noises, excessive engine speed, low fuel or excessive coolant temperature, as well as status information relating to body functions, such as for example heart frequency.

The invention is further directed to a system for implementing the method of claim 1, wherein three serially connected assemblies are provided, namely means for detecting the status information, a processing-and control unit, and means for action upon the terminal. Such a system easily enables the terminal to be acted upon by the pre-processed status information, the normal function of the terminal in each case being temporarily suppressed by—in the sense of being entirely replaced or partially superimposed by—the pre-processed signals.

In accordance with an advantageous further development of the invention, in addition to the system components, transmission means are provided by which the status information can be forwarded not only to the terminal but also wirelessly to a central station. If the terminal is a mobile telephone, the mobile telephone cellular network can be used for this purpose. Status information of interest not only to the road user comprises in particular environmental data, such as instantaneous atmospheric pollutant levels, atmospheric pressure, temperature. These data could be transmitted automatically to a weather service with each telephone call. It would also be conceivable for the status information relating to the body function to be transmitted to the family doctor. A preferred embodiment consists in that the central station calls up the data of interest. This activity could be indicated to the road user, possibly in association with a charge credit or access to the central station data. In accordance with a further aspect of the invention the means for detecting the status information are preferably known sensors. In addition to the sensors which detect vehicle-external status information, sensors for vehicle-internal status information can also be provided. This relates in particular to engine function signals. For example, vehicle noises or engine noises to be evaluated as evidence of deficient vehicle operating reliability, could be indicated by interrupting the sound reproduction of an audio device or mobile telephone.

In accordance with a further aspect of the invention in addition to input-end interfaces and/or signal converters as well as signal processing means, the processing- and control unit can also comprise storage means and/or selection means. On the basis of threshold value criteria, the selection means facilitate a decision as to which sensorial determined status information is forwarded to the terminal. Selection means can also support a priority control function, the activation of additional signaling means, or a type of driving behaviour tutorial function. Optionally provided storage means can additionally be useful for this purpose.

In accordance with a further aspect of this invention, the loudspeakers, displays or vibration elements provided in the respective terminals serve to act upon the terminal. These assemblies, in particular a vibration element, can of course also be additionally provided for this purpose.

Additionally, in accordance with a yet further aspect of the invention, the terminals can be designed such that information is transmitted back, as it were, to the processing- and control device via return transmission elements. This could for example consist of the information as to which device is currently in use.

In the case of a mobile telephone, an automatic announcement to the subscribed could additionally be activated.

BRIEF DESCRIPTION OF THE DRAWINGS

In the following the invention will be described in detail in the form of an exemplary embodiment illustrated in which.

DETAILED DESCRIPTION OF THE INVENTION

Figure 1:
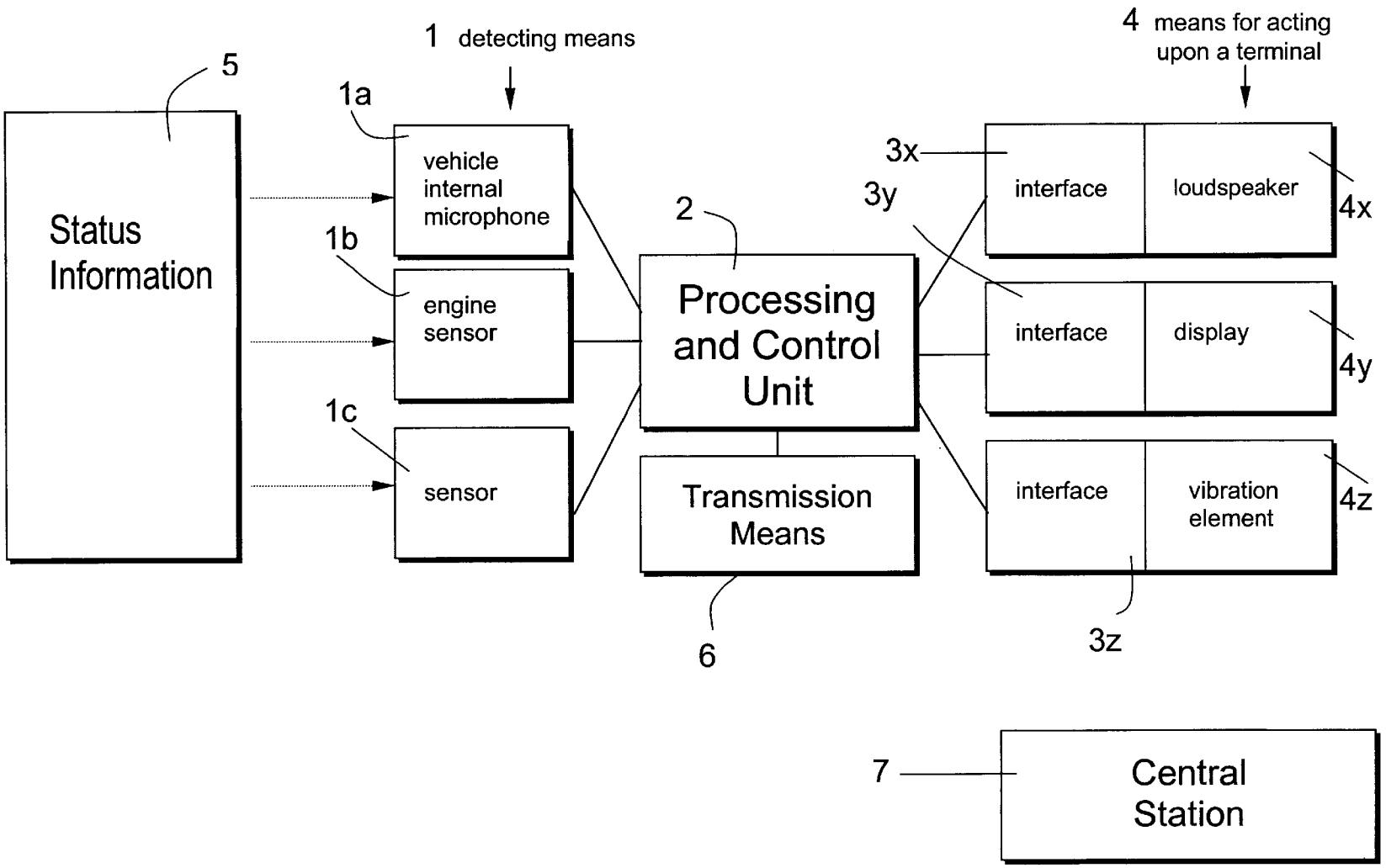
FIG. 1 shows the components of the overall system of one embodiment of the present invention.

A system for signaling traffic-relevant status information 5 to road users substantially comprises means 1 for detecting status information, a processing- and control unit 2, and means 4 for acting upon a terminal. The means 1 for detecting the status information 5 consist either of a vehicle-internal or vehicle-external microphone 1*a* an engine sensor 1*b*, or another sensor 1*c*. These detecting means 1 serve to pick up warning signals, for example from a police- and/or fire-brigade siren, road-works flashing warning lights, traffic lights or engine states, for example speed, coolant temperature and so on. The detected signals are pre-processed by the processing- and control unit 2 and fed via interfaces 3*x*, 3*y*, 3*z* to the means 4 for acting upon the terminal. These means 4 can consist of a loudspeaker 4*x*, a display 4*y* or a vibration element 4*z*. These means 4 for acting upon the terminal form part of the terminal so that the terminals are essentially functionally converted for the acoustic, optical or mechanical signaling of the warning signals.

In the preferred embodiment, existing terminals, in particular a mobile telephone, an audio device, and/or a computer, are used for acoustic and/or optical and/or mechanical signaling, during which time the normal function of the terminal is suppressed. The terminals are functionally converted via interfaces 3*x*, 3*y*, 3*z* in order to signal warning signals to the road user by means of existing assemblies. Acoustic and/or optical and/or mechanical signaling is also to be understood as an additional warning-display or announcement or a vibration alarm, outputted via the means 4 (such as the loadspeaker 4*x*, the display 4*y* or the vibration element 4*z*), which are part of the existing terminal.

The traffic-relevant status information 5 to be signaled to the road user consists primarily of vital warning signals, such as police- or fire-brigade sirens, vehicle flashing hazard signals, flashing police-car lights, illuminated road-works or traffic lights. Also conceivable is the vehicle-internal signaling of environmental status information, such as current pollutant levels, temperature and so on, also status information 5 relating to the vehicle, such as for example vehicle noises from the wheel bearings, engine noises, excessive engine speed, low fuel or excessive coolant temperature, as well as status information 5 relating to body functions, such as heart frequency of the user.

These types of status information 5 are detected (i.e., sensed) by known types of sensors 1 (e.g., a microphone 1*a*, an engine sensor 1*b*, or another known sensor 1*c*), and input to the processing and control unit 2. Such a system easily enables the terminal to be acted upon by the pre-processed status information, the normal function of the terminal in each case being suppressed by—in the sense of being entirely replaced or partially superimposed by—the pre-processed signals sent from the processing and control unit 2.

It will be appreciated that the loudspeaker 4*x*, display 4*y* or vibration element 4*z* provided in the respective terminals serve to act upon the terminal to alert the road user. These assemblies, in particular the vibration element 4*z*, can of course also be additionally provided for this purpose.

Figure 2:
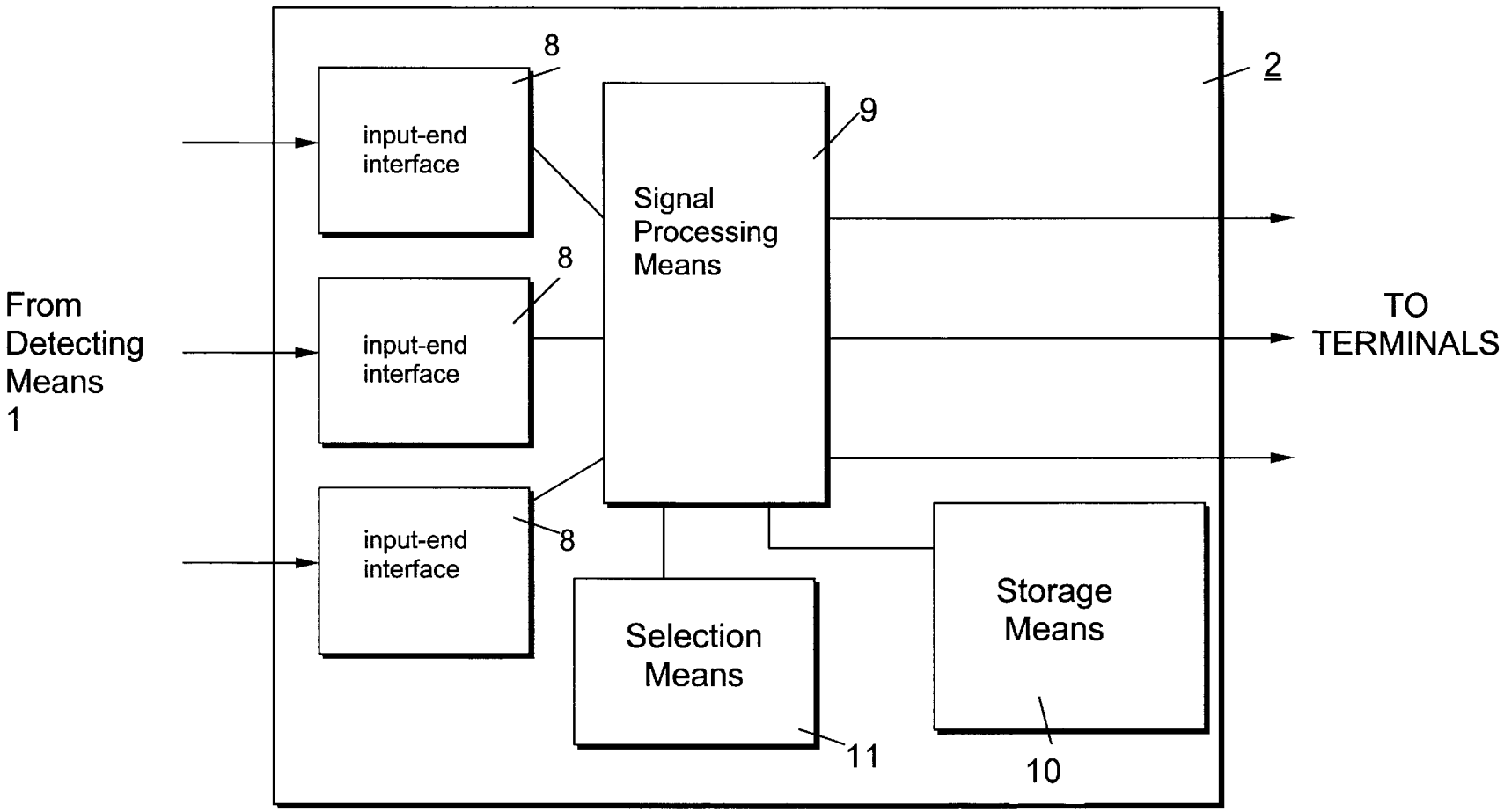
FIG. 2 shows a particular structure of the processing- and control unit shown in FIG. 1.

In accordance with a still further aspect of the invention as shown in FIG. 2, in addition to input-end interfaces and/or signal converters 8 as well as signal processing means 9, the processing- and control unit 2 can also comprise storage means 10 and/or selection means 11. On the basis of threshold value criteria, the selection means 11 facilitate a decision as to which sensorial-determined status information 5 is forwarded to the terminal. Selection means 11 can also support a priority control function, the activation of additional signaling means, or a type of driving behaviour tutorial function. Optionally provided storage means 10 can additionally be useful for this purpose.

In accordance with an advantageous further embodiment of the invention, in addition to the system components described above, transmission means 6 are provided by which the status information 5 can be forwarded not only to the terminal but also to a central station 7 (e.g., via known transmission techniques). If the terminal is a mobile telephone, a mobile telephone cellular network can be used for this purpose. Status information 5 of interest not only to the road user comprises in particular environmental data, such as instantaneous atmospheric pollutant levels, atmospheric pressure, temperature, etc. These data could be transmitted automatically to a weather service station with each telephone call. It is also conceivable for the status information 5 relating to the body functions of the road user to be transmitted to the family doctor. A preferred embodiment consists in that the central station 7 calls up the data of interest. This activity could be indicated to the road user, possibly in association with a charge credit or access to the central station data.

Additionally, in accordance with a yet further aspect of the invention, the terminals can be designed such that information is transmitted back, as it were, to the processing- and control unit 2. This could for example consist of the information as to which terminal is currently in use, and whether certain terminals are on or off.

Figure 3:
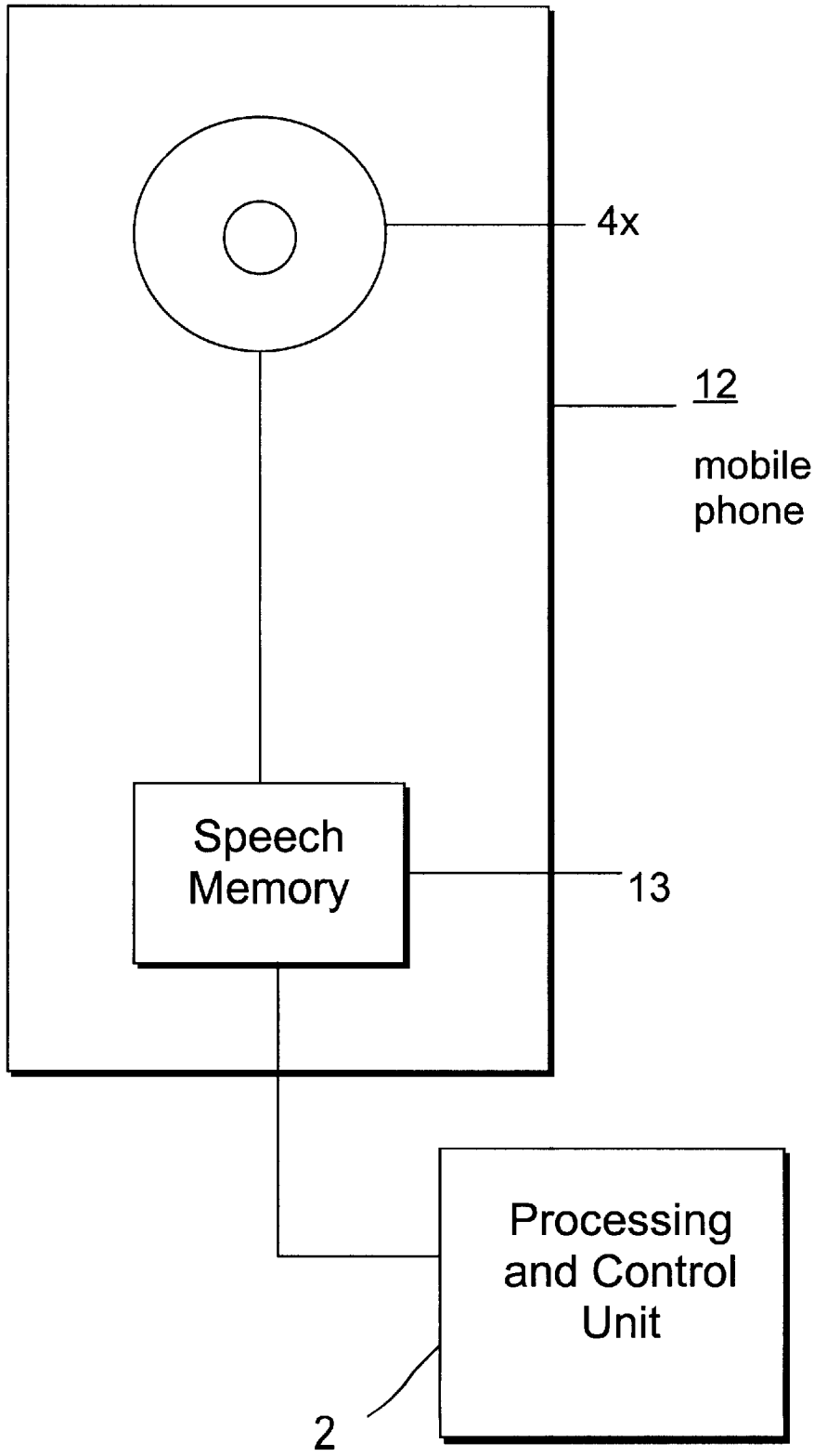
FIG. 3 shows a particular embodiment wherein a mobile telephone is used as a terminal.

Furthermore, in the case of a mobile telephone 12 as a terminal, as shown in FIG. 3, an automatic announcement to the subscriber could additionally be activated by way of a speech memory 13. The speech memory 12 is connected at its input to the processing- and control unit 2, and at its output to the loudspeaker 4*x* of the mobile telephone 12.

What is claimed is:

1. A method of signaling traffic-relevant status information to a road user, wherein the traffic-relevant status information comprises warning signals, the method comprising steps of:

sensing one of optical, environmental, engine function-, and body function signals via at least one sensor located in or on a vehicle of the road user; and temporarily suppressing normal functions of an existing terminal located in or on the vehicle of the road user while outputting at least one of acoustical, optical and mechanical signals via the existing terminal, wherein the at least one outputted acoustical, optical and mechanical signal output from the existing terminal is based on a sensed one of the optical, environmental, engine function-, and body function signals, wherein the environmental signals correspond to ambient environmental conditions data that includes pollutant levels, atmospheric temperature and atmospheric pressure and the environmental data signals do not include acoustic signals, the engine function signals correspond to engine conditions of the vehicle of the road user, and the body function signals correspond to the road user's body functions, wherein said normal functions comprise two-way communication in both reception and transmission directions of communication.

2. A method according to claim 1, further comprising:

wirelessly transmitting the traffic-related status information from the vehicle of the road user to at least one remote central station.

3. The method of claim 1, wherein said road user's body functions comprise heart frequency.

4. The method of claim 1, wherein said traffic-relevant status information comprises hazard signals and police car lights.

5. The method of claim 1, wherein said mechanical signal comprises a vibration.

6. The method of claim 1, wherein said engine conditions comprise at least one of wheel bearing noise, excessive engine speed, low fuel and high temperature.

7. A system for signaling traffic-relevant status information to a road user, comprising:

at least one terminal located in or on a vehicle of the road user, wherein the terminal is a two-way communication device, wherein the normal two-way communication functions of the at least one terminal are temporarily suppressed in both reception and transmission directions of communication during the output by the system of at least one of acoustical, optical and mechanical signals via the terminal;

at least one status information detecting device operable to detect the traffic-relevant status information;

a processing- and control unit, having an input connected to the status information detecting device; and at least one terminal signal output device, formed as part of the at least one terminal and operable to output a traffic-relevant status information signal from the at least one terminal, wherein the at least one terminal signal output device has an input connected to the processing- and control unit.

8. A system according to claim 7, further comprising:

a transmitter, connected to the processing- and control unit, operable to wirelessly transmit the status information from the vehicle of the road user to at least one remote central station.

9. A system according to claim 8, wherein the at least one remote central station is one of a weather service station and a disaster control service station.

10. A system according to claim 7, wherein the at least one status information detecting device is a sensor operable to sense at least one of acoustical, optical, environmental, engine function-, and body function signals, wherein the environmental signals correspond to environmental conditions data, wherein the engine function signals correspond to engine conditions of the vehicle of the road user, and wherein the body function signals correspond to the road user's body functions.

11. A system according to claim 7, wherein the processing- and control unit comprises:

at least one of input-end interfaces and signal converters operable to receive a traffic-relevant status information signal from the at least one status information detecting device;

a signal processor operable to process the traffic-relevant status information signal; and a selection device, located in or on the vehicle of the road user, operable to select which sensorially-determined status information is forwarded to the at least one terminal, wherein the selection device makes the selection based on threshold value criteria, and wherein the selection device further operates to prioritize the sensorial-determined status information, thereby controlling which sensorial-determined status information is forwarded to the at least one terminal in a prioritized manner.

12. A system according to claim 7, wherein the at least one terminal signal output device comprises at least one of a loudspeaker, a display, and a vibration element.

13. A system according to claim 7, wherein the at least one terminal signal output device further comprises a return-transmission element operable to transmit information from the at least one terminal to the processing-and control unit.

14. A system according to claim 13, wherein the information transmitted to the processing- and control unit includes whether the at least one terminal is on or off.

15. A system according to claim 7, wherein the at least one terminal is a mobile telephone, and wherein the at least one terminal signal output device, formed as part of the mobile telephone, comprises a speech memory for automatic announcements, wherein the speech memory has an input connected to the processing- and control unit and an output connected to a loudspeaker of the mobile telephone.

16. The system of claim 7, further comprising an on-board computer that performs said two-way communication, wherein a mobile telephone is not used.

17. A system for signaling traffic-relevant status information to a road user, comprising:

at least one terminal located in or on a vehicle of the rod user, wherein the normal functions of the at least one terminal are temporarily suppressed during the output by the system of the at least one of acoustical, optical and mechanical signals via the terminal;

at least one status information detecting device, located in or on vehicle of the road user, operable to detect the traffic-relevant status information;

a processing and control unit, having an input connected to the status information detecting device;

at least one terminal signal output device, formed as part of the at least one terminal and operable to output a traffic-relevant status information signal from the at least one terminal, wherein the at least one terminal signal output device has an input connected to the processing and control unit.

at least one remote central station operable to wirelessly receive the traffic-relevant status information transmitted from the vehicle of the road user; and a transmitter, connected to the processing and control unit, operable to wirelessly transmit the traffic-relevant status information from the vehicle of the road user to the at least one remote central station, wherein the traffic-relevant status information includes environmental condition parameters comprising pollutant levels, atmospheric pressure and atmospheric temperature, wherein said normal functions comprise tow-way communication in both reception and transmission directions of communication.

18. A system according to claim 17, wherein the processing- and control unit comprises:

at least one of input-end interfaces and signals converters operable to receive a traffic-relevant status information signal from the at least one status information detecting device;

a signal processor operable to process the traffic-relevant status information signal; and a selection device, located in or on the vehicle of the road user, operable to select which sensorial-determined status information is forwarded to the at least one terminal, wherein the selection device makes the selection based on threshold value criteria, and wherein the selection device further operates to prioritized the sensorially-determined status information, thereby controlling which sensorial-determined status information is forwarded to the at least one terminal in a prioritized manner.

19. A system according to claim 18, further comprising:

a transmitter, connected to the processing- and control unit, operable to wirelessly transmit the status information from the vehicle of the road user to at least one remote central station.

20. A system according to claim 18, wherein the at least one terminal signal output device comprises at least one of a loudspeaker, a display, and a vibration element.

21. A system according to claim 18, wherein the at least one terminal signal output device further comprises a return-transmission element operable to transmit information from the at least one terminal to the processing-and control unit.

22. A system according to claim 21, wherein the information transmitted to the processing- and control unit includes whether the at least one terminal is on or off.

23. A system according to claim 18, wherein the at least one terminal is a mobile telephone, and wherein the at least one terminal signal output device, formed as part of the mobile telephone, comprises a speech memory for automatic announcements, wherein the speech memory has an input connected to the processing- and control unit and an output connected to a loudspeaker of the mobile telephone.

24. A system according to claim 18, wherein the at least one status information detecting device is a sensor operable to sense at least one of acoustical, optical, environmental, engine function-, and body function signals, wherein the environmental signals correspond to environmental conditions data, wherein the engine function signals correspond to engine conditions of the vehicle of the road user, and wherein the body function signals correspond to the road user's body functions.

25. A system according to claim 1, wherein the at least one terminal signal output device comprises at least one of a loudspeaker, a display, and a vibration element.

26. A system according to claim 2, wherein the at least one terminal is a mobile telephone, and wherein the at least one terminal signal output device, formed as part of the mobile telephone, comprises a speech memory for automatic announcements, wherein the speech memory has an input connected to the processing- and control unit and an output connected to a loudspeaker of the mobile telephone.

27. A system according to claim 17, wherein the at least one terminal signal output device further comprises a return-transmission element operable to transmit information from the at least one terminal to the processing-and control unit.

28. A system according to claim 27, wherein the information transmitted to the processing- and control unit includes whether the at least one terminal is on or off.

29. A system according to claim 17, wherein the at least one terminal is a mobile telephone, and wherein the at least one terminal signal output device, formed as part of the mobile telephone, comprises a speech memory for automatic announcements, wherein the speech memory has an input connected to the processing- and control unit and an output connected to a loudspeaker of the mobile telephone.

30. A system according to claim 17, wherein the at least one status information detecting device is a sensor operable to sense at least one of acoustical, optical, environmental, engine function-, and body function signals, wherein the environmental signals correspond to environmental conditions data, wherein the engine function signals correspond to engine conditions of the vehicle of the road user, and wherein the body function signals correspond to the road user's body functions.

31. The system of claim 17, said traffic-relevant status information further comprising human condition data that includes heart rate, and engine function data that includes wheel bearing noise.

32. The system of claim 18, wherein said at least one central remote station initiates data transmission from said vehicle to receive said traffic-relevant status information that further comprises human condition data that includes heart rate, and engine function data that includes wheel bearing noise.

33. A system for signaling traffic-relevant status information to a road user, comprising:

at least one terminal located in or on a vehicle of the road user, wherein the normal functions of the at least one terminal are temporarily suppressed during the output by the system of at least one of acoustical, optical and mechanical signals via the terminal, wherein said normal functions comprise two-way communication in both reception and transmission directions of communication;

at least one status information detecting device, located in or on the vehicle of the road user, operable to detect the traffic-relevant status information;

a processing- and control unit, having an input connected to the status information detecting device; and at least one terminal signal output device, formed as part of the at least one terminal and operable to output a traffic-relevant status information signal from the at least one terminal, wherein the at least one terminal signal output device has an input connected to the processing- and control unit;

wherein the at least one status information detecting device is a sensor operable to sense at least one of optical, environmental, engine function-, and body function signals, wherein the environmental signals correspond to ambient environmental conditions data that includes pollutant levels, atmospheric temperature and atmospheric pressure and the environmental signals do not include acoustic signals, the engine function signals correspond to engine conditions of the vehicle of the road user, and the body functions signals correspond to the road user's body functions.

34. A system according to claim 33, further comprising:

a transmitter, connected to the processing- and control unit, operable to wirelessly transmit the status information from the vehicle of the road user to at least one remote central station.

35. A system according to claim 34, wherein the at least one remote central station is one of a weather service station and a disaster control service station.

36. A system according to claim 33, wherein the processing- and control unit comprises:

at least one of input-end interfaces and signal converters operable to receive a traffic-relevant status information signal from the at least one status information detecting device;

a signal processor operable to process the traffic-relevant status information signal; and a selection device, located in or on the vehicle of the road user, operable to select which sensorial-determined status information is forwarded to the at least one terminal, wherein the selection device makes the selection based on threshold value criteria, and wherein the selection device further operates to prioritize the sensorial-determined status information, thereby controlling which sensorial-determined status information is forwarded to the at least one terminal in a prioritized manner.

37. A system according to claim 33, wherein the at least one terminal signal output device comprises at least one of a loudspeaker, a display, and a vibration element.

38. A system according to claim 33, wherein the at least one terminal signal output device further comprises a return-transmission element operable to transmit information from the at least one terminal to the processing-and control unit.

39. A system according to claim 38, wherein the information transmitted to the processing- and control unit includes whether the at least one terminal is on or off.

40. A system according to claim 33, wherein the at least one terminal is a mobile telephone, and wherein the at least one terminal signal output device, formed as part of the mobile telephone, comprises a speech memory for automatic announcements, wherein the speech memory has an input connected to the processing- and control unit and an output connected to a loudspeaker of the mobile telephone.

41. A system according to claim 33, further comprising a sensor having an output connected to the processing- and control unit and operable to sense acoustical signals.

42. The system of claim 33, wherein said road user's body functions comprise heart frequency, said traffic-relevant status information comprises hazard signals and police car lights, and said mechanical signal comprises a vibration.

43. A system for signaling traffic-relevant status information to a road user, comprising:

at least one terminal located in or on a vehicle of the road user, wherein the normal functions of the at least one terminal are temporarily suppressed during the output by the system of at least one of acoustical, optical and mechanical signals via the terminal;

at least one status information detecting device, located in or on the vehicle of the road user, operable to detect the traffic-relevant status information;

a processing- and control unit, having an input connected to the status information detecting device; and at least one terminal signal output device, formed as part of the at least one terminal and operable to output a traffic-relevant status information signal from the at least one terminal, wherein the at least one terminal signal output device has an input connected to the processing- and control unit;

wherein the at least one terminal signal output device further comprise a return-transmission element operable to automatically transmit information from the at least one terminal to the processing- and control unit and provide a feedback mechanism for said system, and wherein said normal functions comprise an on-board computer that performs two-way communication, wherein a mobile telephone is not used and reception and transmission functions are suppressed during said output.

44. A system according to claim 43, further comprising:

a transmitter, connected to the processing- and control unit, operable to wirelessly transmit the status information from the vehicle of the road user to at least one remote central station.

45. A system according to claim 44, wherein the at least one remote central station is one of a weather service station and a disaster control service station.

46. A system according to claim 43, wherein the processing- and control unit comprises:

at least one of input-end interfaces and signal converters operable to receive a traffic-relevant status information signal from the at least one status information detecting device;

a signal processor operable to process the traffic-relevant status information signal; and a selection device, located in or on the vehicle of the road user, operable to select which sensorial-determined status information is forwarded to the at least one terminal, wherein the selection device makes the selection based on threshold value criteria, and wherein the selection device further operates to prioritize the sensorial-determined status information, thereby controlling which sensorial-determined status information is forwarded to the at least one terminal in a prioritized manner.

47. A system according to claim 43, wherein the at least one terminal signal output device comprises at least one of a loudspeaker, a display, and a vibration element.

48. A system according to claim 43, wherein the information transmitted to the processing- and control unit includes whether the at least one terminal is on or off.

49. A system according to claim 43, wherein the at least one terminal is a mobile telephone, and wherein the at least one terminal signal output device, formed as part of the mobile telephone, comprises a speech memory for automatic announcements, wherein the speech memory has an input connected to the processing- and control unit and an output connected to a loudspeaker of the mobile telephone.

50. A system according to claim 43, wherein the at least one status information detecting device is a sensor operable to sense at least one of acoustical, optical, environmental, engine function-, and body function signals, wherein the environmental signals correspond to environmental conditions data, wherein the engine function signals correspond to engine conditions of the vehicle of the road user, and wherein the body function signals correspond to the road user's body functions.

51. A method of signaling traffic-relevant status information to a road user, wherein the traffic-relevant status information comprises warning signals, the method comprising the steps of:

sensing environmental and body function signals via at least one sensor located in or on a vehicle of the road user; and temporarily suppressing normal two-way communication functions of an existing terminal in both reception and transmission directions of communication, said existing terminal located in or on the vehicle of the road user while outputting at least one of acoustical, optical and mechanical signals via the existing terminal, wherein the at least one acoustical, optical and mechanical signal outputted from the existing terminals is based on a sensed one of the environmental and body function signals, wherein the environmental signals correspond to ambient environmental conditions data and comprises pollutant levels and the environmental signals do not comprise acoustic signals and the body function signals correspond to the road user's body functions and comprise heart frequency information.

52. A system for signaling traffic-relevant status information to road user, comprising:

at least one terminal located in or on a vehicle of the road user, wherein the terminal is a two-way communication device, wherein the normal two-way communication functions of the at least one terminal are temporarily suppressed in both reception and transmission directions of communication during the output by the system of at least one of acoustical, optical and mechanical signals via the terminal;

at least one status information detecting device operable to detect the traffic-relevant status information that comprises environmental and body function signals;

a processing- and control unit, having an input connected to the status information detecting device; and at least one terminal signal output device, formed as part of the at least one terminal and operable to output a traffic-relevant status information signal from the at least one terminal, wherein the at least one terminal signal output device has an input connected to the processing- and control unit, the environmental signals correspond to ambient environmental conditions data and comprise pollutant levels, atmospheric temperature and atmospheric pressure, and the environmental signals do not comprise acoustic signals, and the body function signals correspond to the road user's body functions and comprise heart frequency information.

* * * * *

UNITED STATES PATENT AND TRADEMARK OFFICE

CERTIFICATE OF CORRECTION

PATENT NO. : 6,452,506 B2
DATED : September 17, 2002
INVENTOR(S) : Michael Wilhelm It is certified that error appears in the above-identified patent and that said Letters Patent is hereby corrected as shown below:

Column 7,
Line 29, please delete "1" and insert -- 17 --
Line 32, delete "2" and insert -- 25 --
Line 66, delete "18" and insert -- 17 --

Signed and Sealed this

Twenty-ninth Day of July, 2003

JAMES E. ROGAN
*Director of the United States Patent and Trademark Office*